US009315025B2

(12) United States Patent
Okui et al.

(10) Patent No.: US 9,315,025 B2
(45) Date of Patent: Apr. 19, 2016

(54) LIQUID EJECTING HEAD

(71) Applicant: SEIKO EPSON CORPORATION, Tokyo (JP)

(72) Inventors: Hiroaki Okui, Azumino (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/328,514

(22) Filed: Jul. 10, 2014

(65) Prior Publication Data

US 2015/0021411 A1 Jan. 22, 2015

(30) Foreign Application Priority Data

Jul. 17, 2013 (JP) ..... 2013-148277

(51) Int. Cl.
*B41J 2/14* (2006.01)
*B41J 2/16* (2006.01)

(52) U.S. Cl.
CPC ..... *B41J 2/1623* (2013.01); *B41J 2/14233* (2013.01); *B41J 2/161* (2013.01); *B41J 2/1607* (2013.01)

(58) Field of Classification Search
CPC ..... B41J 2002/14491; B41J 2/14072; B41J 2/1623; B41J 2/14233; B41J 2002/14241; B41J 2/14274; B41J 2/161; B41J 2/1618
See application file for complete search history.

(56) References Cited

U.S. PATENT DOCUMENTS 6,886,923 B2 * 5/2005 Miyata ..... 347/71
2011/0205312 A1 8/2011 Miyata et al.

FOREIGN PATENT DOCUMENTS

JP 2011-167964 9/2011

* cited by examiner

*Primary Examiner* — Lisa M Solomon
(74) *Attorney, Agent, or Firm* — Workman Nydegger

(57) ABSTRACT

In a liquid ejecting head that includes a pressure generating element which generates pressure fluctuations in a liquid inside a pressure chamber by applying a voltage to an electrode and a wiring member which has a wiring terminal electrically connected to the electrode, and that ejects the liquid through a nozzle by applying the voltage to the electrode and driving the pressure generating element, the liquid ejecting head includes an electrode terminal that is connected to the electrode and is formed in a series over at least a partial region in a bonding region to which the wiring terminal is bonded. The wiring terminal has multiple terminals which are formed by being spaced apart from one another in the bonding region.

4 Claims, 6 Drawing Sheets

LIQUID EJECTING HEAD

BACKGROUND

1. Technical Field

The present invention relates to a liquid ejecting head such as an ink jet type recording head, and particularly relates to a liquid ejecting head including a wiring member.

2. Related Art

A liquid ejecting apparatus is an apparatus that includes a liquid ejecting head which can eject a liquid through a nozzle as a liquid droplet and that ejects various liquids through the liquid ejecting head. For example, a representative liquid ejecting apparatus can include an image recording apparatus such as an ink jet type recording apparatus that includes an ink jet type recording head (hereinafter, referred to as a recording head) and performs recording by ejecting a liquefied ink through a nozzle of the recording head as an ink droplet. In addition to this purpose, the liquid ejecting apparatus is used in ejecting various types of liquid such as color materials used in color filters for a liquid crystal display, organic materials used in an organic electro luminescence (EL) display, and electrode materials used in forming electrodes. Then, the recording head for the image recording apparatus ejects the liquefied ink, and a color material ejecting head for a display manufacturing apparatus ejects each solution of red (R), green (G), and blue (B) color materials. In addition, an electrode material ejecting head for an electrode forming apparatus ejects liquefied electrode materials, and a bio-organic material ejecting head for a chip manufacturing apparatus ejects a bio-organic material solution.

The recording head as described above is configured so that the ink droplet is ejected through the nozzle communicating with a pressure chamber by deforming a piezoelectric element (a type of pressure generating element) bonded to a diaphragm to generate pressure fluctuations in the ink inside the pressure chamber. The piezoelectric element has a piezoelectric layer interposed between a common electrode which is common to a plurality of piezoelectric elements and an individual electrode which is individually patterned for the respective piezoelectric elements. In addition, a wiring terminal of a flexible cable is configured to be electrically connected to an electrode terminal of the common electrode and the individual electrode (for example, refer to JP-A-2011-167964). The flexible cable is a film-like wiring member on which an IC for driving the piezoelectric element, such as a chip on film (COF) and a tape career package (TCP) is mounted. Here, each electrode terminal and each wiring terminal corresponding thereto are bonded to each other by an adhesive such as a non-conductive paste (NCP), a non-conductive film (NCF), an anisotropic conductive paste (ACP), and an anisotropic conductive film (ACF). Then, the recording head supplies (applies) a drive voltage to both electrodes of the piezoelectric element via the flexible cable, thereby deforming the piezoelectric layer and ejecting the ink droplet through the nozzle.

Incidentally, in the related art, in order to reduce electrical resistance between the electrode terminal of the common electrode and the wiring terminal corresponding thereto, as illustrated in FIG. 8A, a terminal 81' which is a conductive portion of a wiring terminal 80' is increased as much as possible, and a region electrically connected to an electrode terminal 82' is sufficiently secured. However, in this configuration, a portion other than the terminal 81' in the wiring terminal 80' of a flexible cable 84' is decreased. Consequently, a bonding force between the electrode terminal 82' and the wiring terminal 80' is weakened. In particular, when the electrode terminal 82' and the wiring terminal 80' are bonded to each other by using a non-conductive adhesive 83' such as the NCP or the NCF, the terminal 81' of the wiring terminal 80' and the electrode terminal 82' are brought into contact with each other, and are bonded to each other by the adhesive 83' filling a portion between both terminals 80' and 82' other than a contact portion thereof. Consequently, if a gap into which the adhesive 83' flows is small, the bonding force is significantly weakened. In addition, when gold or platinum is used as a material for the terminal 81' of the wiring terminal 80' or the electrode terminal 82', there is a possibility that an adhesive force by means of the adhesive 83' may be further weakened.

In order to prevent the above-described weakening of the bonding force (adhesive force), as illustrated in FIG. 8B, a configuration is proposed where multiple electrode terminals 82" are divided so as to be arranged by being spaced apart from one another in a bonding region to which the electrode terminal 82" and a wiring terminal 80" are bonded, and multiple terminals 81" of a wiring terminal 80" of a flexible cable 84" are similarly arranged corresponding to the electrode terminals 82". If configured in this way, an adhesive 83" can fill a gap generated in contact portions between the terminal 81" of these wiring terminals 80" and the electrode terminal 82". Accordingly, it is possible to strengthen the bonding force between the electrode terminal 82" and the wiring terminal 80". However, in this configuration, if a bonding position is misaligned between the electrode terminal 82" and the wiring terminal 80" as illustrated in FIG. 8B, there is a possibility that an area cannot be sufficiently secured in a region where the terminal 81" of the wiring terminal 80" and the electrode terminal 82" are electrically connected to each other. Therefore, there is a possibility of increasing electrical resistance between both terminals 80" and 82".

SUMMARY

An advantage of some aspects of the invention is to provide a liquid ejecting head which can prevent poor connection with a wiring member.

In a liquid ejecting apparatus according to an aspect of the invention that includes a pressure generating element which generates pressure fluctuations in a liquid inside a pressure chamber by applying a voltage to an electrode and a wiring member which has a wiring terminal electrically connected to the electrode, and that ejects the liquid through a nozzle by applying the voltage to the electrode and driving the pressure generating element, the electrode has an electrode terminal that is formed in a series over a bonding region to which the wiring terminal is bonded. The wiring terminal has multiple terminals which are formed by being spaced apart from one another inside the bonding region.

According to the aspect of the invention, the wiring terminal has the multiple terminals which are formed by being spaced apart from one another in the bonding region. Therefore, a gap is generated between the terminals, and the gap can be filled with an adhesive when the wiring terminal and the electrode terminal are bonded to each other. This can strengthen a bonding force between the wiring terminal and the electrode terminal. In addition, the electrode terminals are formed in a series over the bonding region. Accordingly, even when a bonding position between the wiring terminal and the electrode terminal is misaligned, it is possible to prevent a decrease in an area of a connecting contact (conductive portion) between the terminal of the wiring terminal and the electrode terminal. This can prevent an increase in electrical resistance between both terminals. As a result, it is possible to prevent poor connection between the wiring member and the liquid ejecting head.

In the above-described configuration, it is preferable that a cross-sectional shape of the terminal on a plane parallel to a bonding surface with the electrode terminal gradually decrease toward the electrode terminal.

According to this configuration, when both terminals are connected to each other by pressing the wiring terminal against the electrode terminal, it is possible to concentrate a pressure on a tip of the terminal of the wiring terminal. This enables reliable conduction between the terminal of the wiring terminal and the electrode terminal.

In the above-described configurations, it is preferable that the wiring terminal and the electrode terminal be bonded to each other by a non-conductive adhesive containing no conductive particles.

According to this configuration, it is possible to use a relatively inexpensive adhesive, and thus, it is possible to reduce the manufacturing cost of the liquid ejecting head.

Furthermore, in the above-described configurations, it is preferable that the electrode terminal be a common electrode terminal that is conductive with a common electrode to which a common voltage common to multiple pressure generating elements is applied, and the wiring terminal be a common wiring terminal that is electrically connected to the common electrode terminal.

According to this configuration, it is possible to prevent the increase in the electrical resistance between the common electrode terminal and the common wiring terminal through which a large amount of electric current flows. As a result, it is possible to further prevent the poor connection between the wiring member and the liquid ejecting head.

BRIEF DESCRIPTION OF THE DRAWINGS

The invention will be described with reference to the accompanying drawings, wherein like numbers like elements.

DESCRIPTION OF EXEMPLARY EMBODIMENTS

Hereinafter, an embodiment according to the invention will be described with reference to the accompanying drawings. In the embodiment described below, various limitations are described as a preferred embodiment of the invention. However, unless the following description is made particularly to limit the invention, the scope of the invention is not limited to these aspects. In the following description, an ink jet type printer (hereinafter referred to as a printer) on which an ink jet type recording head (hereinafter, referred to as a recording head) is mounted will be described as an example of a liquid ejecting apparatus of the invention.

Figure 1:
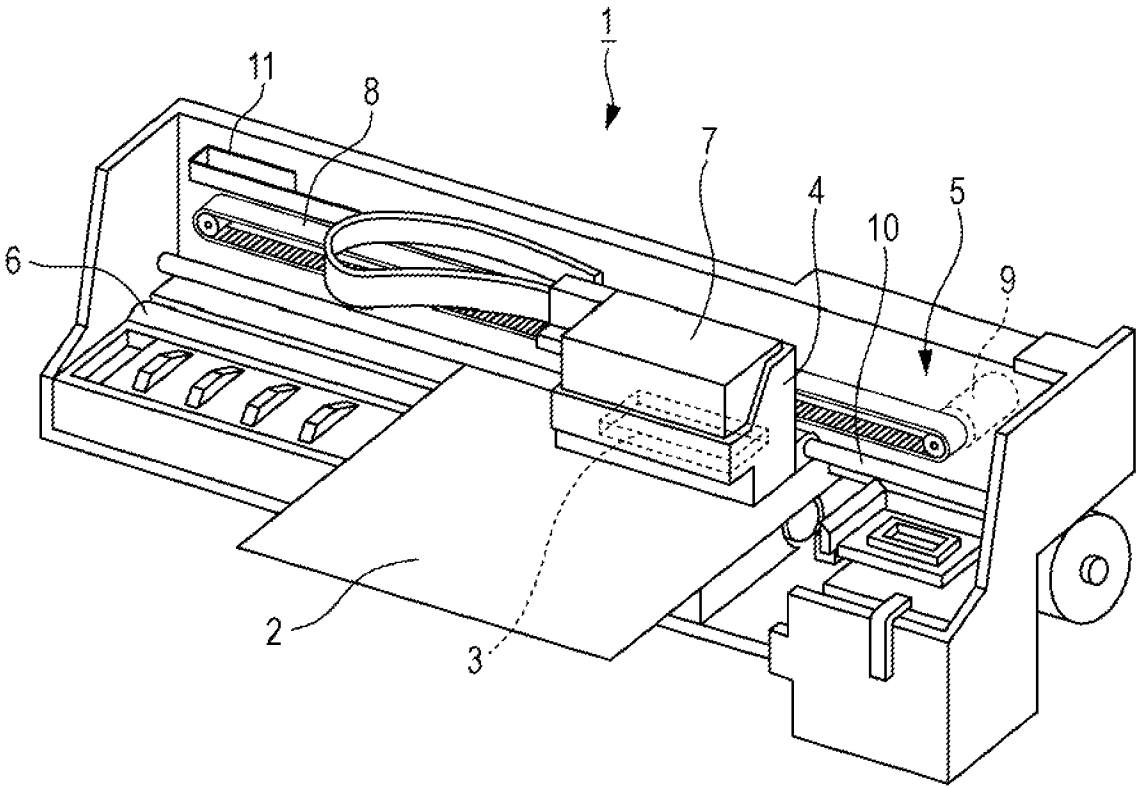
FIG. 1 is a perspective view illustrating a configuration of a printer.

A configuration of a printer 1 will be described with reference to FIG. 1. The printer 1 is an apparatus which performs image recording by ejecting a liquefied ink onto a surface of a recording medium 2 (one type of landing targets) such as a recording sheet. The printer 1 includes a recording head 3 which ejects the ink, a carriage 4 to which the recording head 3 is attached, a carriage moving mechanism 5 which moves the carriage 4 in a main scanning direction, and a transport mechanism 6 which transports the recording medium 2 in a sub-scanning direction. The above-described ink is stored in an ink cartridge 7 serving as a liquid supply source. The ink cartridge 7 is mounted to be attachable to and detachable from the recording head 3. It is also possible to employ a configuration where an ink cartridge is arranged on a main body side of a printer and an ink is supplied from the ink cartridge to a recording head through an ink supply tube.

The above-described carriage moving mechanism 5 includes a timing belt 8. The timing belt 8 is driven by a pulse motor 9 such as a DC motor. Accordingly, if the pulse motor 9 is operated, the carriage 4 is guided to a guide rod 10 disposed across the printer 1, and is reciprocally moved in the main scanning direction (width direction of the recording medium 2). A position of the carriage 4 in the main scanning direction is detected by a linear encoder 11 which is one type of positional information detection units. The linear encoder 11 transmits a detection signal thereof, that is, an encoder pulse (one type of positional information), to a control unit (not illustrated) of the printer 1.

Figure 2:
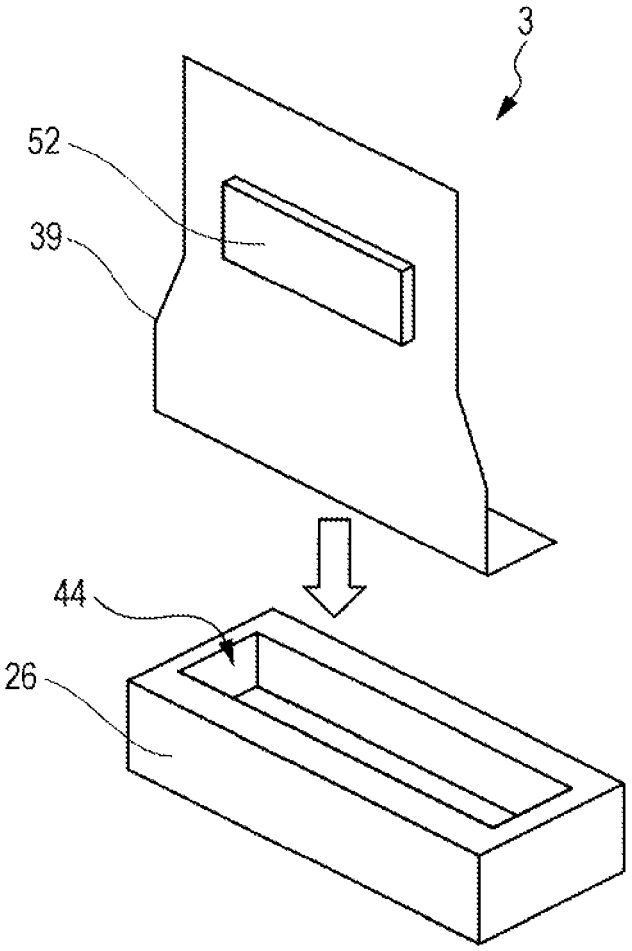
FIG. 2 is a perspective view illustrating a configuration of a recording head.
Figure 3:
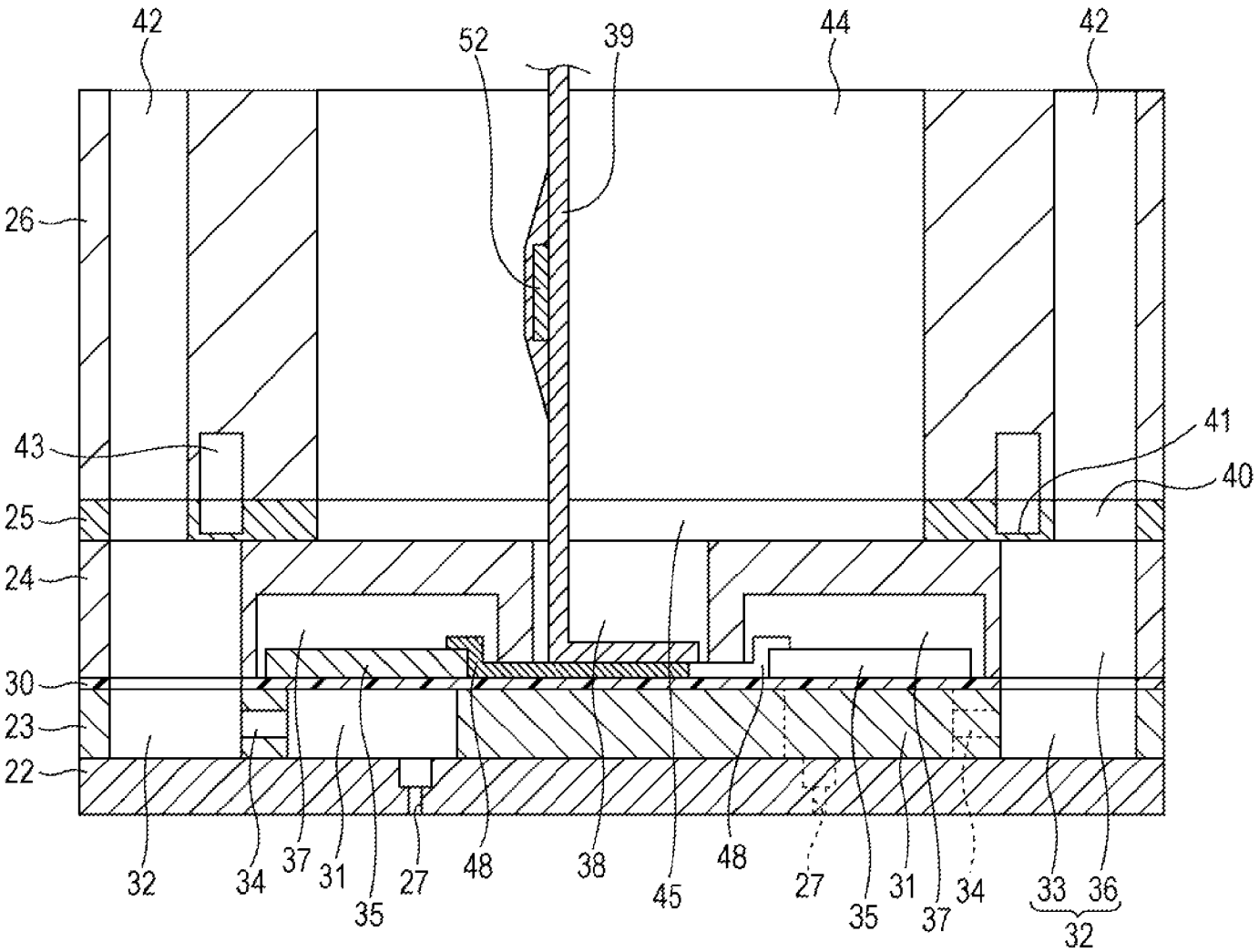
FIG. 3 is a cross-sectional view of a recording head.

Next, the recording head 3 will be described. FIG. 2 is a perspective view illustrating a configuration of the recording head 3, and FIG. 3 is a cross-sectional view of the recording head 3. In the recording head 3 in the present embodiment, an upper surface and a side surface thereof are mainly configured to have a case 26 (to be described later), and one end side of a flexible cable 39 (to be described later) is inserted into a hollow 44 which is opened in the case 26. In addition, a nozzle plate 22, a channel substrate 23, a common liquid chamber substrate 24 and a compliance substrate 25 are stacked, and then are attached to a lower surface side of the case 26. For the sake of convenience, a stacking direction of the respective members will be described as a vertical direction.

The nozzle plate 22 (one type of nozzle forming members) is a plate-shaped member in which multiple nozzles 27 are opened in rows at a pitch corresponding to dot formation density. For example, 300 nozzles 27 are disposed in rows at a pitch corresponding to 300 dpi, thereby configuring nozzle rows (one type of nozzle groups). In the embodiment, two nozzle rows are formed in the nozzle plate 22.

In the channel substrate 23, an upper surface thereof (surface of the common liquid chamber substrate 24) is formed so that a very thin elastic body film 30 made of silicon dioxide is subjected to thermal oxidation. In the channel substrate 23, as illustrated in FIG. 3, multiple pressure chambers 31 which are divided by multiple partition walls through an anisotropic etching process are formed to correspond to the respective nozzles 27. Outside the row of the pressure chamber 31 in the channel substrate 23, a communicating hollow 33 is formed which divides a portion of a common liquid chamber 32 serving as a chamber to which the ink common to the respective pressure chambers 31 is introduced. The communicating hollow 33 communicates with the respective pressure chambers 31 via an ink supply channel 34.

On an elastic body film 30 of an upper surface of the channel substrate 23, a piezoelectric element 35 (one type of the pressure generating elements in the invention) formed by sequentially stacking a lower electrode film (common element electrode 46) made of metal, a piezoelectric layer (not illustrated) made of lead zirconate titanate (PZT), and an upper electrode film (individual element electrode 47) made of metal is formed for each of the pressure chambers 31. In the embodiment, corresponding to two rows of the nozzles, two rows of the piezoelectric elements are juxtaposed in a direction orthogonal to the nozzle rows in a state where the piezoelectric elements 35 alternate with each other when viewed in a nozzle row direction (nozzle row arraying direction). The piezoelectric element 35 is a piezoelectric element in a so-called flexure mode, and is formed so as to cover an upper portion of the pressure chamber 31. Electrode wires 48 and 49 are respectively extended from respective electrodes 46 and 47 onto the elastic body film 30 (refer to FIG. 4). It is also possible to employ a configuration where the lower electrode film is the individual element electrode and the upper electrode film is the common element electrode.

The common liquid chamber substrate 24 (protective substrate) having a penetrating hollow 36 penetrating in a thickness direction is arranged on the channel substrate 23 having the piezoelectric element 35. The penetrating hollow 36 in the common liquid chamber substrate 24 communicates with the communicating hollow 33 of the channel substrate 23, and divides a portion of the common liquid chamber 32. In addition, a piezoelectric element accommodating hollow 37 having a size so as not to hinder driving of the piezoelectric element 35 in a region opposing the piezoelectric element 35 is formed in the common liquid chamber substrate 24. Furthermore, in the common liquid chamber substrate 24, a wiring hollow 38 penetrating in the thickness direction of the substrate is formed between the adjacent piezoelectric element rows. In a plan view, an individual electrode terminal 48*a* and a common electrode terminal 49*a* of the piezoelectric element 35 (refer to FIG. 4) are arranged inside the wiring hollow 38. In addition, layout of the electrode terminals 48*a* and 49*a* will be described later.

The compliance substrate 25 is arranged on an upper surface side of the common liquid chamber substrate 24. In a region opposing the penetrating hollow 36 of the common liquid chamber substrate 24 in the compliance substrate 25, an ink introduction port 40 for supplying the ink from the ink cartridge 7 side to the common liquid chamber 32 is formed by penetrating in the thickness direction. In addition, a region other than the ink introduction port 40 and a through-hole 45 (to be described later) in a region opposing the penetrating hollow 36 of the compliance substrate 25 is adapted to be a flexible portion 41 which is very thinly formed. The flexible portion 41 seals an upper portion opening of the penetrating hollow 36, thereby forming the divided common liquid chamber 32. Then, the flexible portion 41 functions as a compliance which absorbs pressure fluctuations in the ink inside the common liquid chamber 32. Furthermore, the through-hole 45 is formed in a central portion of the compliance substrate 25. The through-hole 45 communicates with the hollow 44 of the case 26.

The case 26 is a member where an ink introduction channel 42 is formed which communicates with the ink introduction port 40 and supplies the ink introduced from the ink cartridge 7 side to the common liquid chamber 32 side, and where a recess 43 is formed which allows expansion of the flexible portion 41 in the region opposing the flexible portion 41. The hollow 44 penetrating in the thickness direction is opened in the central portion of the case 26. One end side of the flexible cable 39 is inserted into the hollow 44, and is connected to the respective electrode terminals 48*a* and 49*a*.

Then, the nozzle plate 22, the channel substrate 23, the common liquid chamber substrate 24, the compliance substrate 25, and the case 26 are bonded to one another by being heated in a stacked state arranged between adhesives or heat welding films.

The recording head 3 configured as described above feeds the ink from the ink cartridge 7 to the common liquid chamber 32 side through the ink introduction channel 42, and fills an ink channel (one type of liquid channels) extending from the common liquid chamber 32 to the nozzle 27 with the ink. Then, the recording head 3 supplies a drive voltage from the flexible cable 39 to the piezoelectric element 35, and deforms the piezoelectric element 35 to be bent. In this manner, the recording head 3 causes the pressure fluctuations in the ink inside the corresponding pressure chamber 31, thereby ejecting the ink through the nozzle 27 by utilizing the pressure fluctuations in the ink.

Figure 4:
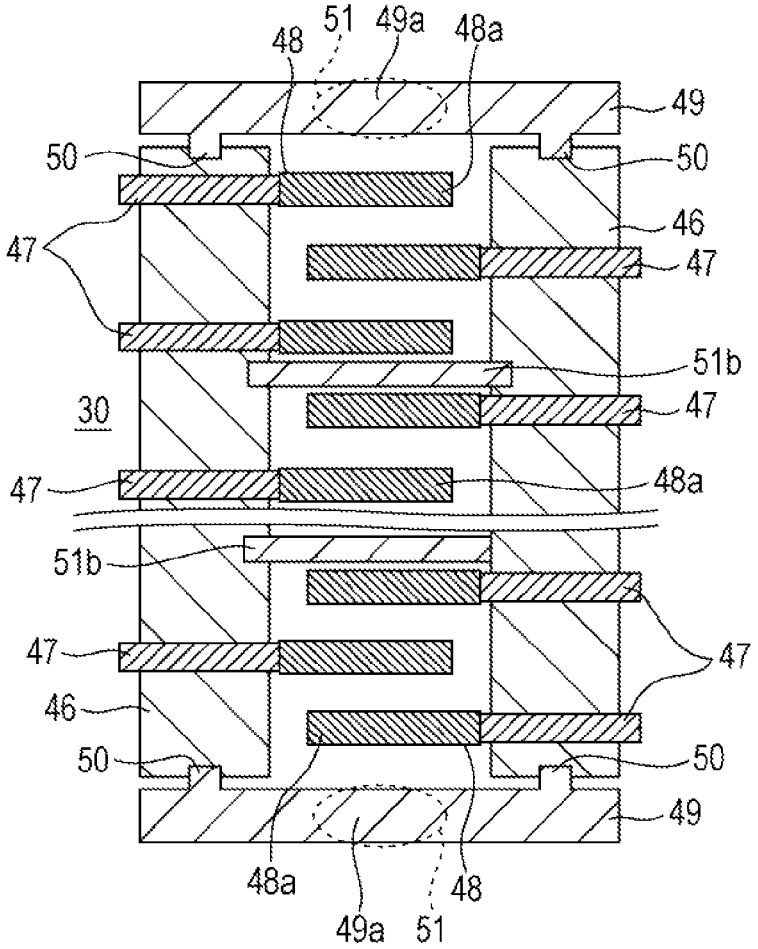
FIG. 4 is a schematic view illustrating layout of an electrode of a piezoelectric element.

FIG. 4 is a schematic view illustrating layout of the electrodes 46 and 47 of the piezoelectric element 35 and the electrode wires 48 and 49 extending from the electrodes 46 and 47. In FIG. 4, a portion illustrated by dark hatching represents the individual element electrode 47 and the individual electrode wire 48 which is conductive therewith, and a portion illustrated by light hatching represents the common element electrode 46 and the common electrode wire 49 which is conductive therewith. In addition, a portion having the common element electrode 46 and the common electrode wire 49 corresponds to the common electrode (one type of electrodes in the invention) which applies a common voltage common to the multiple piezoelectric elements 35 arrayed in two rows. Furthermore, a portion having the individual element electrode 47 and the individual electrode wire 48 corresponds to the individual electrode which applies an individual voltage which is individual to the piezoelectric elements 35. In FIG. 4, a vertical direction represents the nozzle row arraying direction (piezoelectric element arraying direction), and a configuration corresponding to two rows of the nozzles is illustrated. In the embodiment, gold or platinum is used as the material of the electrode film.

In the embodiment, the common element electrode 46 common to the respective piezoelectric elements 35 is continuously formed on the elastic body film 30 dividing a portion of the pressure chamber 31, along the nozzle row direction, in a rectangular shape in a plan view which is elongated in the same direction. Then, the piezoelectric layer (not illustrated) and the individual element electrode 47 are sequentially stacked on the common element electrode 46, and are patterned for each of the piezoelectric elements 35. The individual electrode wire 48 which corresponds to each of the individual element electrodes 47 and is conductive with the individual element electrode 47 is formed between the adjacent nozzle rows. The individual electrode wire 48 corresponding to one side (left side in FIG. 4) nozzle row and the individual electrode wire 48 corresponding to the other side (right side in FIG. 4) nozzle row are arranged in rows at regular intervals so as to alternately line up in the nozzle row direction. An end portion of these individual electrode wires 48 functions as the individual electrode terminal 48*a* which is electrically connected to an individual wiring terminal 53 (refer to FIG. 5) of the flexible cable 39.

The common electrode wires 49 are respectively formed on both sides in the nozzle row direction of the respective common element electrodes 46. The common electrode wire 49 extends along a direction orthogonal to the nozzle row direction across two rows of the common element electrodes 46, and then serves as the electrode wire common to these common element electrodes 46. This common electrode wire 49 has a branch electrode 50 protruding to the common element electrode 46 in a portion corresponding to the respective common element electrodes 46, and is conductive with the respective common element electrodes 46 through the branch electrode 50. The respective common element electrodes 46 and the common electrode wire 49 may be formed in a series of frame shapes without interposing the branch electrode 50 therebetween. In addition, in the common electrode wire 49, a portion positioned on both sides in an arraying direction of the individual electrode terminal 48*a* (portion surrounded by a dashed line ellipse in FIG. 4) is the common electrode terminal 49*a*, and is a common terminal bonding region 51 (corresponding to the bonding region in the invention) to which the common wiring terminal 54 (refer to FIG. 5) of the flexible cable 39 is bonded. That is, the common terminal bonding region 51 is formed in a region between one side piezoelectric element row and the other side piezoelectric element row, in the direction orthogonal to the nozzle row direction. Then, the common electrode terminal 49*a* is continuously (in a series) formed without interruption over an entire range of the common terminal bonding region 51. In the embodiment, tolerance of the bonding position of the common wiring terminal 54 is considered. Accordingly, a region on the elastic body film 30 (common terminal bonding region 51) which is sufficiently wider than the width (dimension in the nozzle row direction) and the length (dimension in the direction orthogonal to the nozzle row direction) of the common wiring terminal 54 is completely covered with a solid metal film made of platinum or gold. That is, the solid metal film covering the inside of the region (common terminal bonding region 51) functions as the common electrode terminal 49*a*. The width of the common electrode terminal 49*a* is set to be sufficiently wider than the width of the individual electrode terminal 48*a* (individual electrode wire 48).

Figure 5:
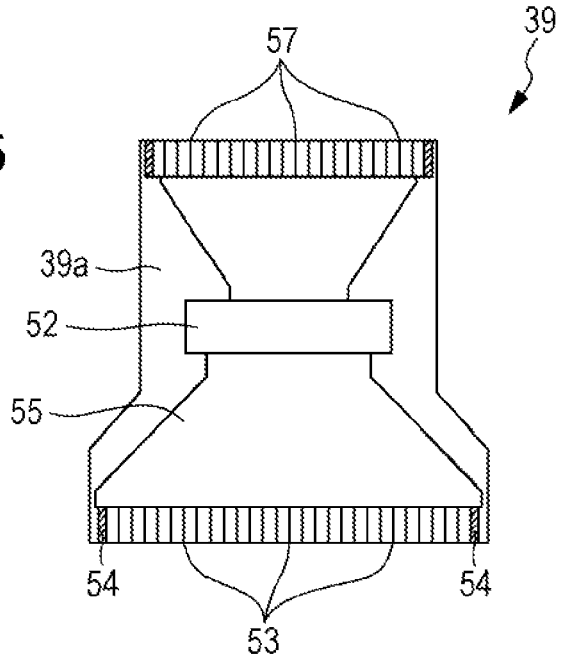
FIG. 5 is a schematic view of a flexible cable.

FIG. 5 illustrates a configuration of the flexible cable 39. The flexible cable 39 is one type of wiring member where a conductor foil which is made of copper or gold, a resist, and an insulator film made of polyimide are stacked on a rectangular-shaped base film 39*a* made of polyimide. A control IC 52 which controls the drive voltage applied to the piezoelectric element 35 is mounted on one surface (front surface) of the flexible cable 39, and a pattern of an electrode wire 55 connected to the control IC 52 is also formed on the surface.

Figure 6:
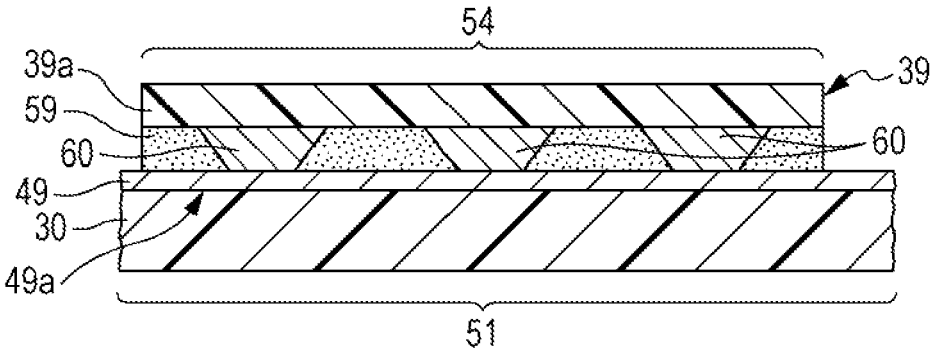
FIG. 6 is an enlarged cross-sectional view of a connecting contact between a common electrode terminal and a common wiring terminal.

On the front surface side of one end portion (upper side end portion in FIG. 5) of the flexible cable 39, a substrate side wiring terminal 57 connected to a substrate terminal of a substrate (not illustrated) which relays a signal transmitted from the main body side of the printer (signal corresponding to the common voltage or the individual voltage) is disposed in multiple rows. In addition, in the other end portion (lower side end portion in FIG. 5) on the front surface side of the flexible cable 39, a common wiring terminal 54 electrically connected to the common electrode terminal 49*a* and an individual wiring terminal 53 electrically connected to the individual electrode terminal 48*a* are disposed in multiple rows. The respective wiring terminals 53 and 54 and the substrate side wiring terminal 57 are in a state where the conductive portion made of copper or gold is exposed on the base film 39*a*. The conductive portion in the individual wiring terminal 53 is formed to correspond to the shape of the individual electrode terminal 48*a*, in a rectangular shape in a plan view which is elongated in the direction orthogonal to the nozzle row direction. In contrast, as illustrated in FIG. 6, the conductive portion in the common wiring terminal 54 is configured to have multiple terminals 60 which are formed to be spaced apart from one another in the direction orthogonal to the nozzle row direction. The terminal 60 of the common wiring terminal 54 will be described in detail later.

In the embodiment, the common electrode terminal 49*a* is formed on both sides of the individual electrode terminal 48*a* disposed in multiple rows. Accordingly, corresponding thereto, the common wiring terminal 54 is formed on both sides of the individual wiring terminal 53 disposed in multiple rows (refer to FIG. 5). A portion other than the wiring terminals 53, 54, and 57 within the front surface is covered with the insulator film. In addition, the flexible cable 39 is not limited to the example described in the embodiment. It is possible to employ those which have the control IC or the electrode wire arranged on the other surface (rear surface) or both surfaces of the flexible cable.

As illustrated in FIG. 2, the flexible cable 39 having this configuration is connected to the recording head 3 in a state where the other end portion having the arrayed wiring terminals 53 and 54 is bent toward the other surface (rear surface) at a substantially right angle. In the embodiment, the respective electrode terminals 48*a* and 49*a* of the recording head 3 and the respective wiring terminals 53 and 54 of the flexible cable 39 are bonded to each other by a non-conductive adhesive 59 containing no conductive particles such as a non-conductive paste (NCP) and a non-conductive film (NCF). For example, the adhesive 59 is applied to the portion having the electrode terminals 48*a* and 49*a* arrayed on the elastic body film 30. The bent portion of the flexible cable 39 is pressed from above in a state where the position of the respective wiring terminals 53 and 54 is aligned with the position of the respective electrode terminals 48*a* and 49*a*. In this manner, the electrode terminals 48*a* and 49*a* come into contact with the corresponding wiring terminals 53 and 54 (conductive portions of the wiring terminals 53 and 54) so as to be conductive with each other, and the adhesive 59 positioned in a conductive point is pressed out to a position away from the conductive point. The pressed-out adhesive 59 flows into a gap between the terminal 60 of the common wiring terminal 54 as will be described later. In this state, heat is applied to the adhesive 59 to cure the adhesive 59, thereby bonding the front surface of the other end portion of the flexible cable 39 to the elastic body film 30. In this manner, the respective electrode terminals 48*a* and 49*a* and the respective wiring terminals 53 and 54 are bonded to each other. As the adhesive 59, it is possible to use a conductive adhesive containing conductive particles such as an anisotropic conductive paste (ACP) and an anisotropic conductive film (ACF). In this case, the electrode terminals 48*a* and 49*a* are conductive with the corresponding wiring terminals 53 and 54 via the conductive particles.

Figure 7:
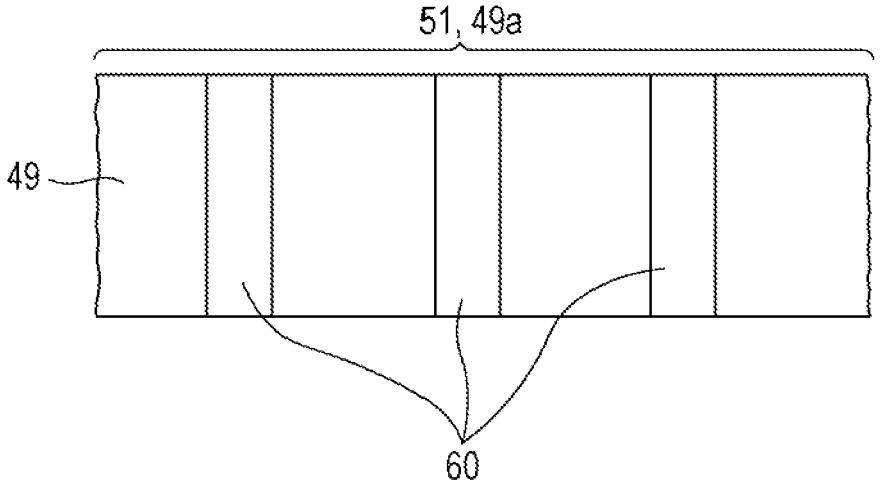
FIG. 7 is a plan view illustrating a positional relationship between a common electrode terminal and a terminal of a common wiring terminal.
Figure 8A:
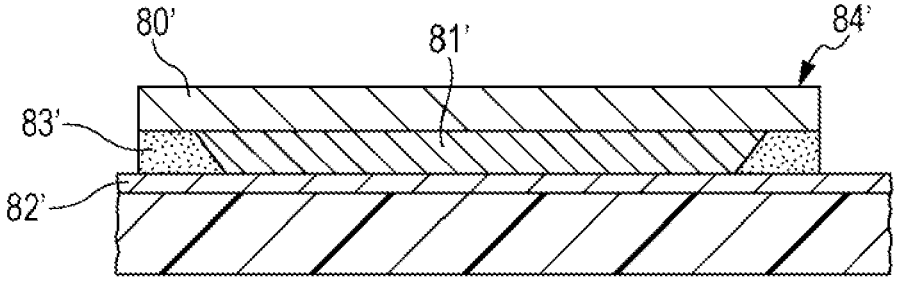
FIGS. 8A and 8B are enlarged cross-sectional views of a connecting contact between a common electrode terminal and a common wiring terminal in a recording head in the related art.
Figure 8B:
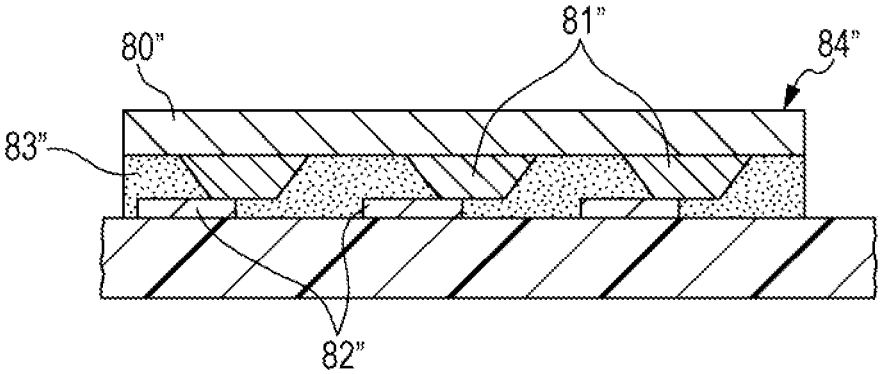

FIG. 6 is an enlarged cross-sectional view of a connecting contact between the common electrode terminal 49*a* and the common wiring terminal 54. FIG. 7 is a plan view illustrating a positional relationship between the common electrode terminal 49*a* and the terminals 60 of the common wiring terminal 54. As illustrated in FIGS. 6 and 7, the common wiring terminal 54 of the invention has the multiple terminals 60 which are formed to be spaced apart from one another inside the common terminal bonding region 51. In detail, the terminal 60 of the common wiring terminal 54 is formed of copper or gold, and protrudes from the front surface of the base film 39*a* of the flexible cable 39 toward the common electrode wire 49 side. Each of the terminals 60 in the embodiment is formed in a rectangular shape in a plan view which is elongated in the nozzle row direction, and in which the dimension in the nozzle row direction is aligned with the dimension in the same direction of the common electrode terminal 49*a*. In addition, in the embodiment, three terminals 60 are juxtaposed along the direction orthogonal to the nozzle row (extending direction of the common electrode wire 49), inside the common terminal bonding region 51. Furthermore, each of the terminals 60 is formed so that a cross-sectional shape on a surface parallel to a bonding surface with the common electrode terminal 49*a* (dimension in the extending direction of the common electrode wire 49) gradually decreases toward the common electrode terminal 49*a*. That is, the terminal 60 is formed in a trapezoidal shape in cross-section in the direction orthogonal to the nozzle row. When the shape of the terminal 60 is a tapered shape (trapezoidal shape) which gradually decreases toward the common electrode terminal 49*a*, at least tip portions of the terminals 60 may be formed to be spaced apart from one another. Base portions of the terminals 60 may be continuously formed without being spaced apart from one another.

Then, a tip of the terminal 60 and the common electrode terminal 49*a* come into contact with each other. In this manner, the common electrode terminal 49*a* and the common wiring terminal 54 are electrically connected to each other. In addition, the adhesive 59 fills a portion between the base film 39*a* and the common electrode terminal 49*a* inside the common terminal bonding region 51, which is a portion other than the portion where the tip of the terminal 60 and the common electrode terminal 49*a* come into contact with each other, that is a gap between the terminals 60. For example, three terminals 60 are electrically connected to each other in a region away from the common wiring terminal 54. Alternatively, in the common wiring terminal 54, the three terminals 60 are electrically connected to each other via a conductive layer formed inside the base film 39*a* or on the rear surface of the base film 39*a*.

As described above, the common wiring terminal 54 has the multiple terminals 60 formed to be spaced apart from one another inside the common terminal bonding region 51. Accordingly, a gap is formed between the terminals 60, and the gap can be filled with the adhesive 59. In this manner, it is possible to increase the bonding force between the common wiring terminal 54 and the common electrode terminal 49*a*. In addition, the common electrode terminal 49*a* is formed in a series over the common terminal bonding region 51. Accordingly, even if the bonding position is misaligned between the common wiring terminal 54 and the common electrode terminal 49*a*, it is possible to prevent a decrease in the area of the connecting contact (conductive portion) between the terminal 60 of the common wiring terminal 54 and the common electrode terminal 49*a*. This can prevent the increase in the electrical resistance between both terminals 49*a* and 54. As a result, it is possible to prevent poor connection between the flexible cable 39 and the recording head 3. The configuration is employed where the cross-sectional shape of the terminal 60 on a surface parallel to the bonding surface with the common electrode terminal 49*a* gradually decreases toward the common electrode terminal 49*a*. Accordingly, when both terminals 49*a* and 54 are connected to each other by pressing the common wiring terminal 54 against the common electrode terminal 49*a*, it is possible to concentrate the pressure on the tip of the terminal 60 of the common wiring terminal 54. This enables reliable conduction between the terminal 60 of the common wiring terminal 54 and the common electrode terminal 49*a*.

Furthermore, the common wiring terminal 54 and the common electrode terminal 49*a* are bonded to each other by the non-conductive adhesive 59 containing no conductive particles. Accordingly, it is possible to use a relatively inexpensive adhesive, and it is possible to reduce the manufacturing cost of the recording head 3. Then, the common electrode terminal 49*a* is formed in a series over the common terminal bonding region 51, and the terminals 60 of the common wiring terminal 54 are formed to be spaced apart from one another inside the common terminal bonding region 51. Accordingly, it is possible to prevent the increase in the electrical resistance between the common electrode terminal 49*a* and the common wiring terminal 54 through which a relatively large amount of electric current flows. As a result, it is possible to further prevent the poor connection between the flexible cable 39 and the recording head 3.

Incidentally, in the above-described embodiment, the terminals 60 of the common wiring terminal 54 are juxtaposed along the direction orthogonal to the nozzle row (extending direction of the common electrode wire 49), inside the common terminal bonding region 51. However, the invention is not limited thereto. For example, the terminals of the common wiring terminal can also be juxtaposed along the nozzle row direction (width direction of the common electrode wire), inside the common terminal bonding region. In addition, three terminals 60 of the common wiring terminal 54 are juxtaposed inside the common terminal bonding region 51. However, the invention is not limited thereto. In short, an embodiment may be made so that two or more terminals are formed to be spaced apart from one another inside the common terminal bonding region. Furthermore, in the above-described embodiment, the terminals 60 are juxtaposed in the common wiring terminal 54. However, the invention is not limited thereto. For example, the terminals may be juxtaposed in the individual wiring terminal. Even in this case, the individual electrode terminal is formed in a series over the individual terminal bonding region which is bonded to the individual wiring terminal of the flexible cable.

Hitherto, the ink jet type recording head 3 which is one type of the liquid ejecting heads has been described as an example. However, the invention can also be applied to other liquid ejecting heads having a configuration where the drive voltage is supplied to the pressure generating element through the flexible cable. For example, the invention can also be applied to a color material ejecting head used in manufacturing color filters for a liquid crystal display, an electrode material ejecting head used in forming electrodes for an organic electro luminescence (EL) display and a field emission display (FED), and a bio-organic material ejecting head used in manufacturing biochips (biochemical elements).

The entire disclosure of Japanese Patent Application No. 2013-148277, filed Jul. 17, 2013 is incorporated by reference herein.

What is claimed is:

1. A liquid ejecting head that includes a pressure generating element which generates pressure fluctuations in a liquid inside a pressure chamber by applying a voltage to an electrode and a wiring member which has a wiring terminal electrically connected to the electrode, and that ejects the liquid through a nozzle by applying the voltage to the electrode and driving the pressure generating element, the liquid ejecting head comprising:

an electrode terminal that is connected to the electrode, wherein the wiring terminal has multiple terminals which are formed by being spaced apart from one another in at least a partial region in the bonding region with the electrode terminal, wherein the electrode terminal is formed over multiple terminals of the wiring terminal in at least a partial region in a bonding region to which the wiring terminal is bonded.

2. The liquid ejecting head according to claim 1, wherein a cross-sectional shape of the multiple terminals on a plane parallel to a bonding surface with the electrode terminal gradually decreases toward the electrode terminal.

3. The liquid ejecting head according to claim 1, wherein the wiring terminal and the electrode terminal are bonded to each other by a non-conductive adhesive containing no conductive particles.

4. The liquid ejecting head according to claim 1, wherein the electrode terminal is a common electrode terminal that is conductive with a common electrode to which a common voltage common to multiple pressure generating elements is applied.

* * * * *